US006930236B2

(12) United States Patent
Jung

(10) Patent No.: US 6,930,236 B2
(45) Date of Patent: Aug. 16, 2005

(54) APPARATUS FOR ANALYZING MUSIC USING SOUNDS OF INSTRUMENTS

(75) Inventor: Doill Jung, Seoul (KR)

(73) Assignee: Amusetec Co., Ltd., (KR)

( * ) Notice: Subject to any disclaimer, the term of this patent is extended or adjusted under 35 U.S.C. 154(b) by 0 days.

(21) Appl. No.: 10/499,588

(22) PCT Filed: Dec. 10, 2002

(86) PCT No.: PCT/KR02/02331

§ 371 (c)(1),
(2), (4) Date: Jun. 18, 2004

(87) PCT Pub. No.: WO03/058599

PCT Pub. Date: Jul. 17, 2003

(65) Prior Publication Data

US 2005/0081702 A1 Apr. 21, 2005

(30) Foreign Application Priority Data

Dec. 18, 2001 (KR) ..... 10-2001-0080805

(51) Int. Cl.[7] ..... G10H 7/00
(52) U.S. Cl. ..... 84/616; 84/654
(58) Field of Search ..... 84/616, 654

(56) References Cited

U.S. PATENT DOCUMENTS 6,784,354 B1 * 8/2004 Lu et al. ..... 84/616
6,856,923 B2 * 2/2005 Jung ..... 702/71

FOREIGN PATENT DOCUMENTS

| | | |
|---|---|---|
| JP | 4-17000 | 1/1992 |
| JP | 11-237884 | 8/1999 |
| KR | 1991-0010395 | 6/1991 |
| KR | 1994-0005043 | 6/1994 |

OTHER PUBLICATIONS

PCT International Search Report; International application No. PCT/KR02/02331; International Filing date: Dec. 10, 2002; Date of Mailing: Mar. 19, 2003.
PCT International Preliminary Examination Report; International application No. PCT/KR02/002331; International Filing date: Dec. 10, 2002; Date of Completion: Apr. 9, 2004.

* cited by examiner

*Primary Examiner*—Jeffrey W Donels
(74) *Attorney, Agent, or Firm*—Cantor Colburn LLP

(57) ABSTRACT

An apparatus for analyzing music based on sound information of instruments is provided. The apparatus uses sound information of instruments or the sound information and score information in order to analyze digital sounds. The sound information of instruments performed to generate digital sounds is previously stored by pitches and strengths so that monophonic notes and polyphonic notes performed by the instruments can be easily analyzed. In addition, by using the sound information, of instruments and score information together, input digital sounds can be accurately analyzed and can be detected in the form of quantitative data.

17 Claims, 14 Drawing Sheets

APPARATUS FOR ANALYZING MUSIC USING SOUNDS OF INSTRUMENTS

TECHNICAL FIELD

The present invention relates to an apparatus for analyzing music based on sound information of instruments, and more particularly, to an apparatus for analyzing music input in the form of digital sound by comparing frequency components of input digital sound signals with frequency components of sound information of instruments previously stored by pitches and strengths.

BACKGROUND ART

Since personal computers started to be spread in the 1980's, computer technology, performance and environments have been rapidly developed. In the 1990's, Internet was rapidly spread to various departments of companies and personal life. Therefore, use of computers has been very important in every field throughout the world in the 21st century, and techniques of applying computers to the field of music have been also developed. In particular, technology of music analysis using computer technology and digital signal processing technology has been developed in various viewpoints, but satisfactory results have never been obtained.

DISCLOSURE OF THE INVENTION

The present invention provides an apparatus for analyzing music input in the form of digital sounds, by which sound information of instruments are previously stored by pitches and strengths and frequency components of input digital sound signals are compared with frequency components of the previously stored sound information of instruments so that the more accurate result of analyzing the music performance can be obtained and the analyzed result can be extracted in the form of quantitative data.

The present invention also provides an apparatus for analyzing music input in the form of digital sounds based on sound information of instruments previously stored by pitches and strengths and score information on a score to be performed.

According to an aspect of the present invention, there is provided an apparatus for analyzing music. The apparatus includes a sound information storage unit, which separately stores sound information by types of instruments; a sound information selection unit, which selects sound information of a particular instrument from the sound information of different types of instruments stored in the sound information storage unit and outputs the selected sound information; a digital sound input unit, which receives externally performed music and converts it into a digital sound signal; a frequency analysis unit, which receives the digital sound signal from the digital sound input unit, decomposes it into frequency components, and outputs the frequency components in units of frames; a comparison/analysis unit, which receives the sound information output from the sound information selection unit and the frequency components output from the frequency analysis unit in units of frames, selects a lowest peak frequency from peak frequencies of the frequency components in each frame output from the frequency analysis unit, and detects sound information including the lowest peak frequency from the sound information output from the sound information selection unit; a monophonic component detection unit, which receives the detected sound information, the frequency components of the digital sound signal, and the lowest peak frequency from the comparison/analysis unit and detects, as a monophonic component, sound information that has peak information most similar to the lowest peak frequency in the sound information; a monophonic component removing unit, which receives the lowest peak frequency that has been used to detect the monophonic component and the frequency components of the digital sound signal from the monophonic component detection unit, removes the lowest peak frequency from the frequency components, and transmits the result of the removal to the comparison/analysis unit; a performance sound information detection unit, which combines monophonic components, which have been detected by the monophonic component detection unit, to detect performance sound information; and a performance sound information output unit, which outputs the performance sound information.

According to another aspect of the present invention, there is provided an apparatus for analyzing music. The apparatus includes a sound information storage unit, which separately stores sound information by types of instruments; a sound information selection unit, which selects sound information of a particular instrument from the sound information of different types of instruments stored in the sound information storage unit and outputs the selected sound information; a score information storage unit, which stores information on a score to be performed by a particular instrument, i.e., score information; a digital sound input unit, which receives externally performed music and converts it into a digital sound signal; a frequency analysis unit, which receives the digital sound signal from the digital sound input unit, decomposes it into frequency components, and outputs the frequency components in units of frames; an expected performance value generation unit, which commences an operation in response to an external control signal, generates expected performance values in units of frames based on the score information stored in the score information storage unit as time lapses since it commenced the operation, and outputs the expected performance value in units of frames; a comparison/analysis unit, which receives the sound information output from the sound information selection unit, the frequency components output in units of frames from the frequency analysis unit, and the expected performance values output from the expected performance value generation unit, selects a lowest expected performance value from expected performance values that have not been compared with the frequency components, detects sound information corresponding to the lowest expected performance value, and determines whether the detected sound information corresponding to the lowest expected performance value is included in the frequency components; a monophonic component detection unit, which receives the sound information corresponding to the lowest expected performance value and the frequency components and when the comparison/analysis unit determines that the sound information corresponding to the lowest expected performance value is included in the frequency components, detects the received sound information as a monophonic component; a monophonic component removing unit, which receives the monophonic component and the frequency components of the digital sound signal from the monophonic component detection unit, removes the monophonic component from the frequency components, and transmits the result of the removal to the comparison/analysis unit; a performance sound information detection unit, which combines monophonic components, which have been detected by the monophonic component detection unit, to detect performance sound information; and a performance sound information output unit, which outputs the performance sound information.

BEST MODE FOR CARRYING OUT THE INVENTION

Hereinafter, preferred embodiments of an apparatus for analyzing music according to the present invention will be described in detail with reference to the attached drawings.

Figure 1:
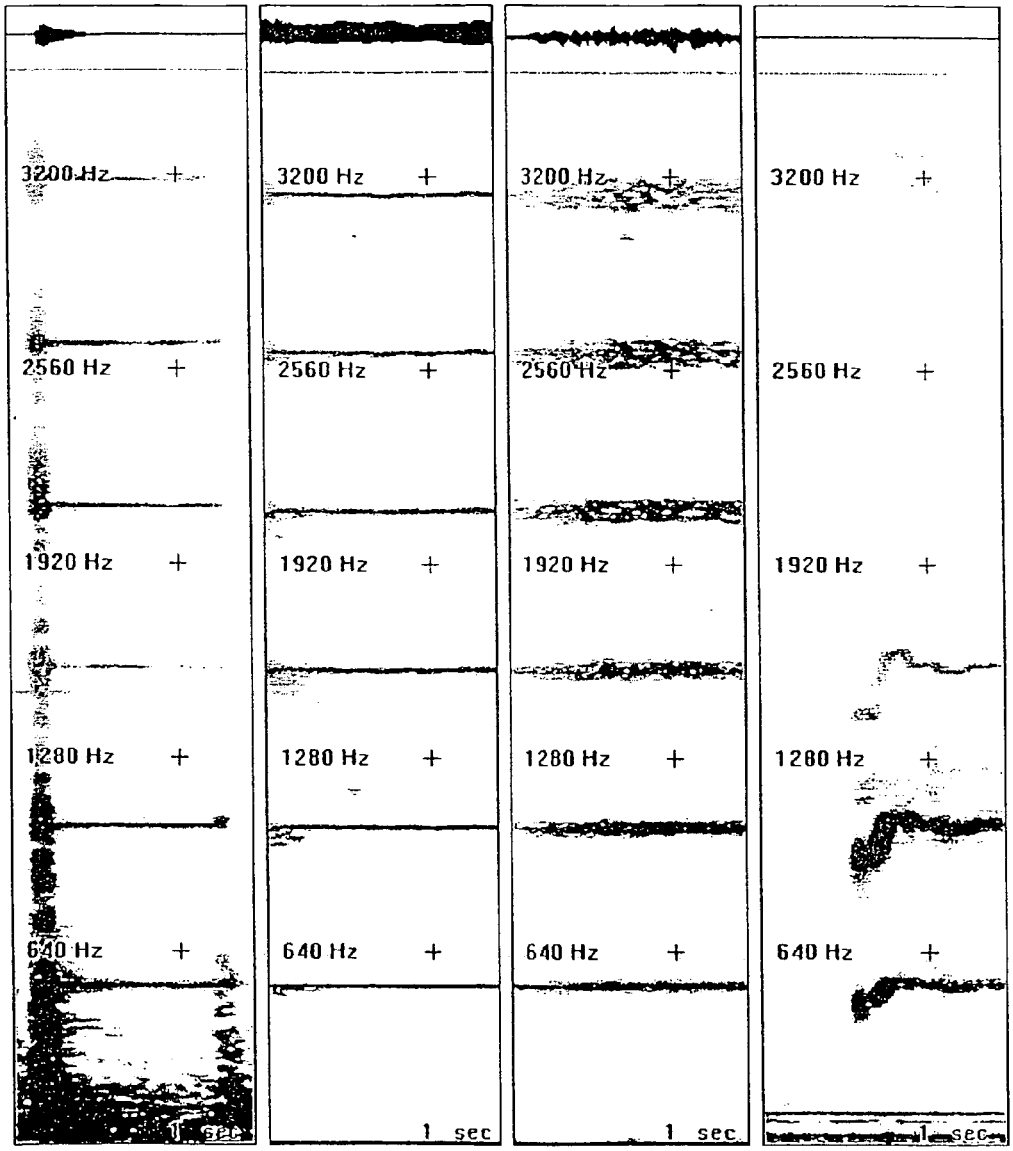
FIG. 1 is a diagram showing examples of sound information of instruments.

FIG. 1 is a diagram showing examples of sound information of instruments. FIG. 1 shows that sound information is different among different types of musical instruments. Sound information (a) expresses a piano sound at a pitch C5. Sound information (b) expresses a trumpet sound at a pitch C5. Sound information (c) expresses a violin sound at a pitch C5. Sound information (d) expresses a female vocal sound at a pitch C5.

Referring to FIG. 1(*a*), since a hammer hit a line when a keyboard is pressed, the strength of a piano sound increases throughout the entire frequency region and each frequency component appears clearly. In the meantime, as time lapses, the strength of a piano sound decreases rapidly.

Referring to FIG. 1(*b*), due to the characteristics of a wind instrument, a trumpet sound has thin and clear harmonic components. However, as harmonics gets higher, vibration gradually occurs little by little.

Referring to FIG. 1(*c*), due to the characteristics of a string instrument, a violin sound has frequency components spread up and down. As harmonics gets higher, frequency spread appears clearly.

Referring to FIG. 1(*d*), due to inaccuracy of a tone, a female vocal sound has frequency components vibrating largely and does not have many harmonic components.

By applying the fact that sound information is different among different types of instruments even if the same pitch is performed, as described above, accurate analysis results can be obtained.

Figure 2:
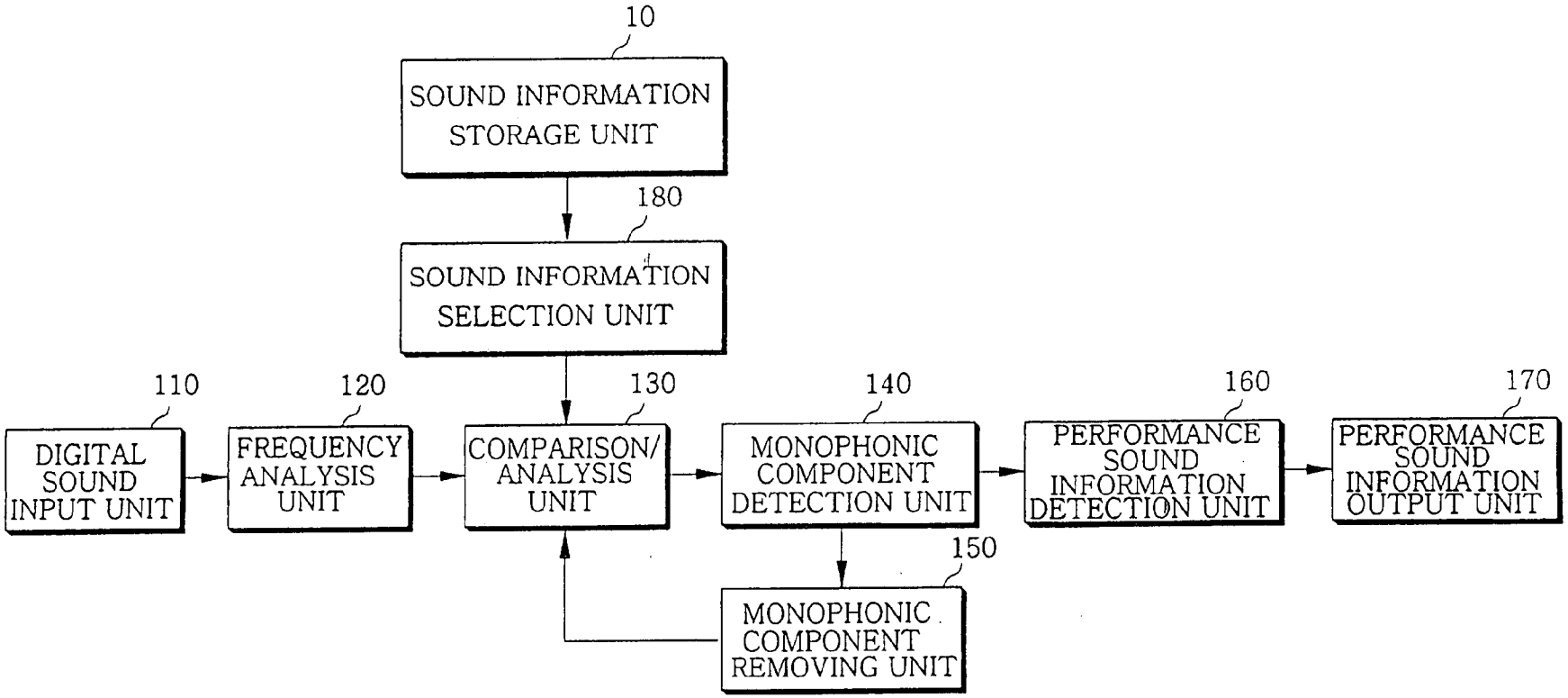
FIG. 2 is a schematic block diagram of an apparatus for analyzing music according to a first embodiment of the present invention.

FIG. 2 is a schematic block diagram of an apparatus for analyzing music according to a first embodiment of the present invention. Referring to FIG. 2, the apparatus for analyzing music according to the first embodiment includes a sound information storage unit 10, a digital sound input unit 110, a frequency analysis unit 120, a comparison/analysis unit 130, a monophonic component detection unit 140, a monophonic component removing unit 150, a performance sound information detection unit 160, a performance sound information output unit 170, and a sound information selection unit 180.

The sound information storage unit 10 separately stores sound information by types of instruments. The sound information selection unit 180 selects sound information "A" of a desired instrument from the sound information of different types of instruments stored in the sound information storage unit 10 and outputs the selected sound information "A". Here, the sound information storage unit 10 stores the sound information in the form of wave data or the strengths of different frequency components. In a case where the sound information is stored in the form of wave data, if the sound information selection unit 180 generates a sound information request, the sound information storage unit 10 detects frequency components of a requested sound from the wave data and provides them.

The digital sound input unit 110 receives externally performed music and converts it into a digital sound signal. The frequency analysis unit 120 receives the digital sound signal from the digital sound input unit 110, decomposes it into frequency components "F" in units of frames, and outputs the frequency components "F" in units of frames.

The comparison/analysis unit 130 receives the sound information "A" that is output from the sound information selection unit 180 and the frequency components "F" that are output from the frequency analysis unit 120 in units of frames and compares them. More specifically, the comparison/analysis unit 130 selects a lowest peak frequency "$F_{PL1}$" from the peak frequencies of the frequency components "F" in a single frame output from the frequency analysis unit 120, and detects sound information "$A_{PL1}$" including the lowest peak frequency "$F_{PL1}$" in the sound information "A" output from the sound information selection unit 180.

The monophonic component detection unit 140 receives the detected sound information "$A_{PL1}$", the frequency components "F", and the lowest peak frequency "$F_{PL1}$" from the comparison/analysis unit 130, and detects, as a monophonic component "$A_S$", sound information that has peak information most similar to the lowest peak frequency "$F_{PL1}$" in the sound information "$A_{PL1}$".

In the meantime, the monophonic component detection unit 140 detects time information of each frame and then detects the pitch and strength of each monophonic note included in each frame. In addition, when the detected monophonic component "$A_S$" is a new one that has not been included in the previous frame, the monophonic component detection unit 140 divides the current frame including the new monophonic component "$A_S$" into a plurality of subframes, founds out a subframe including the new monophonic component "$A_S$", and detects time information of the found subframe together with the monophonic component "$A_S$", i.e., pitch and strength information.

The monophonic component removing unit 150 receives the lowest peak frequency "$F_{PL1}$" and the frequency components "F" from the monophonic component detection unit 140, removes the lowest peak frequency "$F_{PL1}$" from the frequency components "F", and transmits the result of the removal ($F \leftarrow F-F_{PL1}$) to the comparison/analysis unit 130.

Then, the comparison/analysis unit 130 determines whether the frequency components "F" received from the monophonic component removing unit 150 include effective peak frequency information. When it is determined that effective peak frequency information is included in the frequency components "F" received from the monophonic component removing unit 150, the comparison/analysis unit 130 selects a lowest peak frequency "$F_{PL2}$" from the frequency components "F" and detects sound information "$A_{PL2}$" including the lowest peak frequency "$F_{PL2}$". However, when it is determined that effective peak frequency information is not included in the frequency components "F" received from the monophonic component removing unit 150, the comparison/analysis unit 130 receives frequency components of a next frame from the frequency analysis unit 120, selects a lowest peak frequency from peak frequencies included in the received frequency components, and detects sound information including the lowest peak frequency, as described above. In other words, until all monophonic information included in a current frame is detected, the frequency components "F" of the current frame output from the frequency analysis unit 120 are compared with sound information transmitted from the sound information selection unit 180 to be analyzed while sequentially and repeatedly processed by the comparison/analysis unit 130, the monophonic component detection unit 140, and the monophonic component removing unit 150.

The performance sound information detection unit 160 combines monophonic components "$A_S$", which have been detected by the monophonic component detection unit 140, to detect performance sound information. It is apparent that the performance sound information detection unit 160 can detect performance sound information even if polyphonic notes are performed. The performance sound information detection unit 160 detects information on individual monophonic notes included in performance sound of polyphonic notes and combines the detected monophonic information so as to detect performance sound information corresponding to the polyphonic notes.

The performance sound information output unit 170 outputs the performance sound information detected by the performance sound information detection unit 160.

Figure 3:
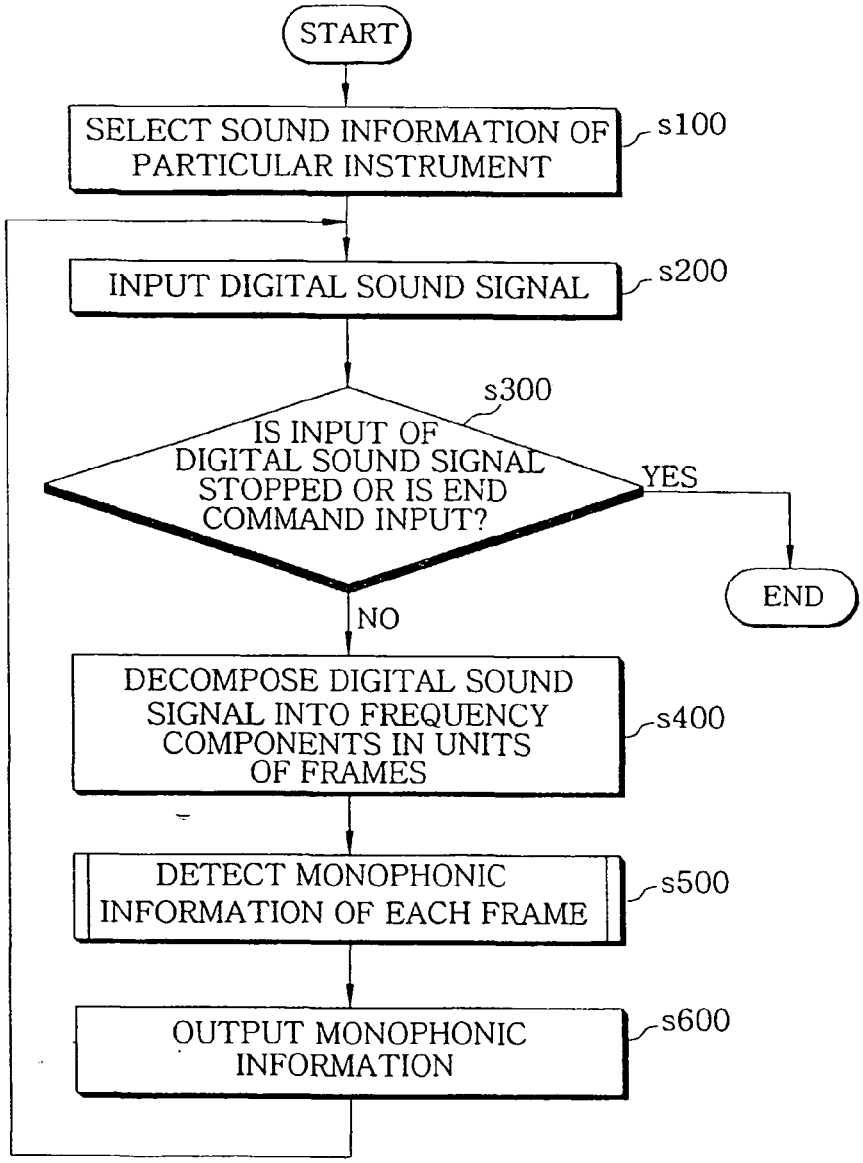
FIG. 3 is a flowchart of a procedure of analyzing music using an apparatus for analyzing music according to the first embodiment of the present invention.
Figure 3A:
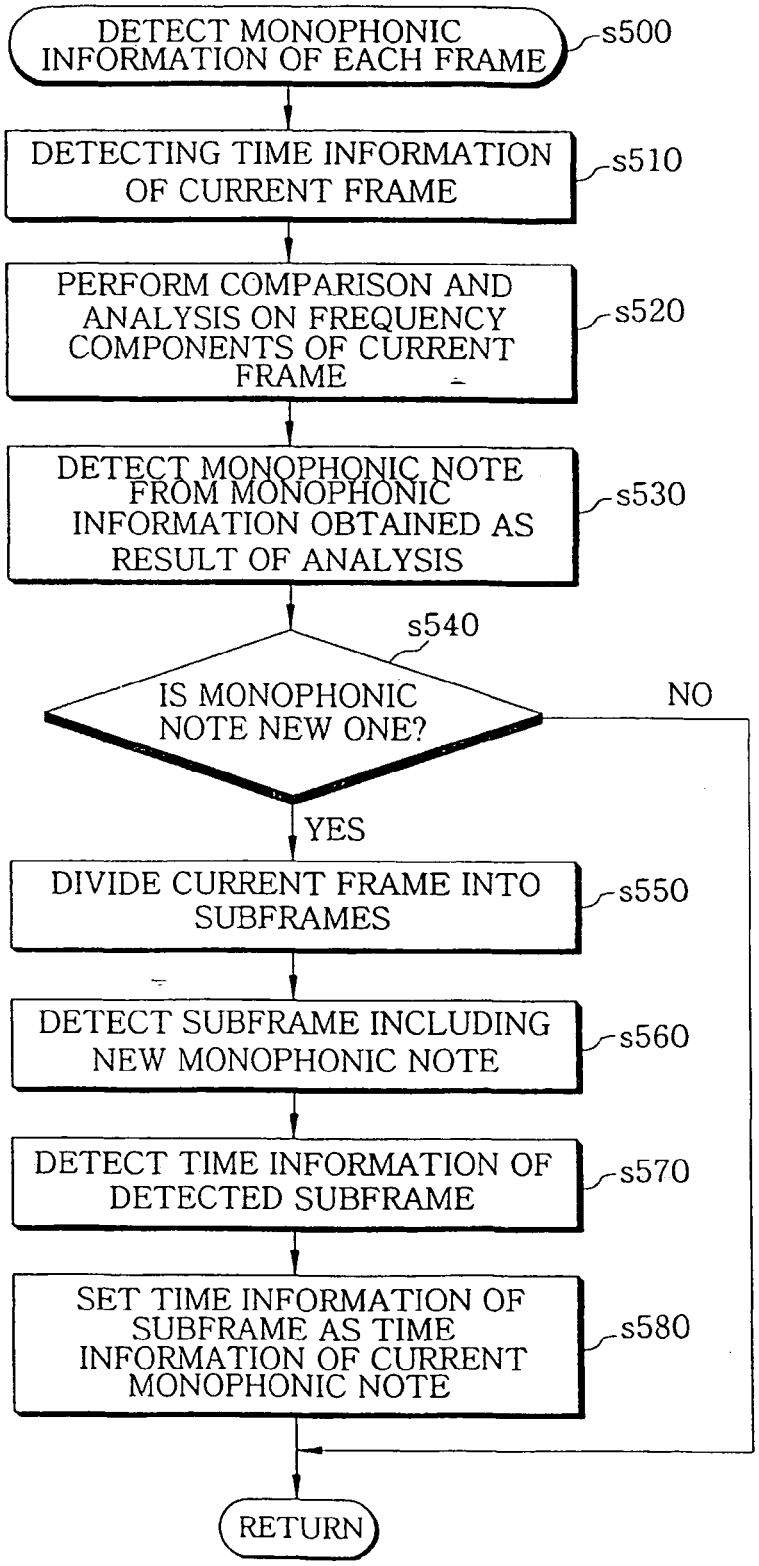
FIG. 3A is a flowchart of a procedure of detecting monophonic information of a frame using an apparatus for analyzing music according to the first embodiment of the present invention.
Figure 3B:
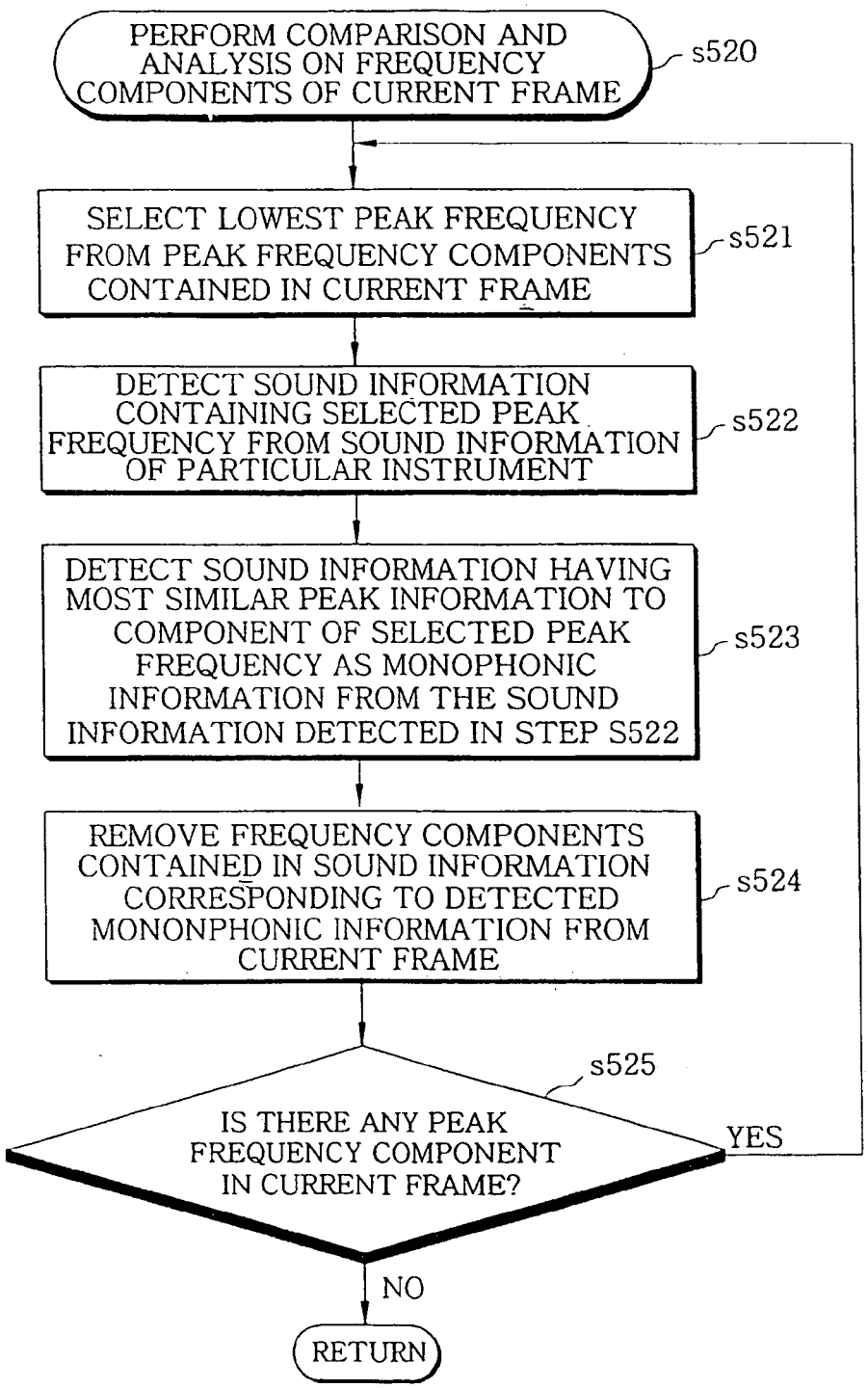
FIG. 3B is a flowchart of a procedure of comparing and analyzing frequency components of a frame using an apparatus for analyzing music according to the first embodiment of the present invention.

FIGS. 3 through 3B are flowcharts of a method performed by an apparatus for analyzing music according to the first embodiment of the present invention.

FIG. 3 is a flowchart of a procedure of analyzing music using an apparatus for analyzing music according to the first embodiment of the present invention. Referring to FIG. 3, after sound information of different types of instruments is generated and stored (not shown), sound information of a particular instrument to be actually played is selected from the stored sound information of different types of instruments in step s100.

Next, if a digital sound signal is input in step s200, the digital sound signal is decomposed into frequency components in units of frames in step s400. The frequency components of the digital sound signal are compared with the frequency components of the selected sound information of the particular instrument and analyzed to detect monophonic information from the digital sound signal in units of frames in step s500. The detected monophonic information is output in step s600.

Steps s200 through s600 are repeated until the input of the digital sound signal is stopped or an end command is input in step s300.

FIG. 3A is a flowchart of step s500 of detecting the monophonic information of each frame using an apparatus for analyzing music according to the first embodiment of the present invention. Referring to FIG. 3A, time information of a current frame is detected in step s510. The frequency components of the current frame are compared with the frequency components of the selected sound information of the particular instrument and analyzed so as to detect the pitch, strength, and time information of each of monophonic notes included in the current frame in step s520. The detected pitch, strength, and time information compose a detected monophonic component in step s530.

If it is determined that the monophonic note detected in step s530 is a new one which is not included in the previous frame in step s540, the current frame is divided into a plurality of subframes in step s550. A subframe including the new monophonic note is detected from the plurality of subframes in step s560. Time information of the detected subframe is detected in step s570. The time information of the subframe is set as the time information of the current monophonic note in step s580. Steps s540 through s580 can be omitted when the detected monophonic note is in a low frequency range, i.e. minimum number of samples to detect the note frequency is greater than subframe size, or when the accuracy of time information is not required.

FIG. 3B is a flowchart of step s520 of comparing and analyzing the frequency components of the current frame using an apparatus for analyzing music according to the first embodiment of the present invention. Referring to FIG. 3B, a lowest peak frequency included in the current frame of the input digital sound signal is selected in step s521. Next, sound information including the selected peak frequency is detected from the sound information of the particular instrument in step s522. In the sound information detected in step s522, sound information having most similar peak information to the component of the selected peak frequency is detected as monophonic information in step s523.

After the monophonic information corresponding to the lowest peak frequency is detected, the frequency components included in the detected monophonic information are removed from the frequency components included in the current frame in step s524. Thereafter, it is determined whether there is any peak frequency component in the current frame in step s525. If it is determined that there is any peak frequency component in the current frame, steps s521 through s524 are repeated.

Figure 4A:
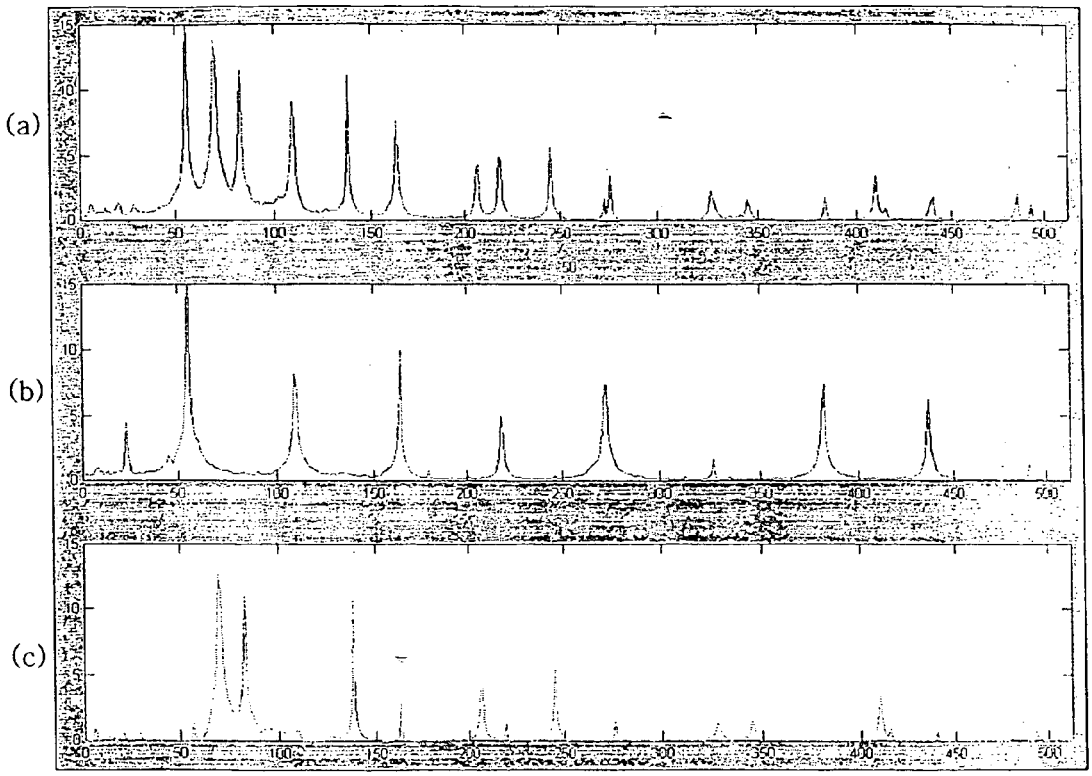
FIGS. 4A through 4C are diagrams showing the waveforms of frequencies in order to explain a procedure in which a monophonic note is detected from a plurality of performing notes using an apparatus for analyzing music according to the first embodiment of the present invention.
Figure 4B:
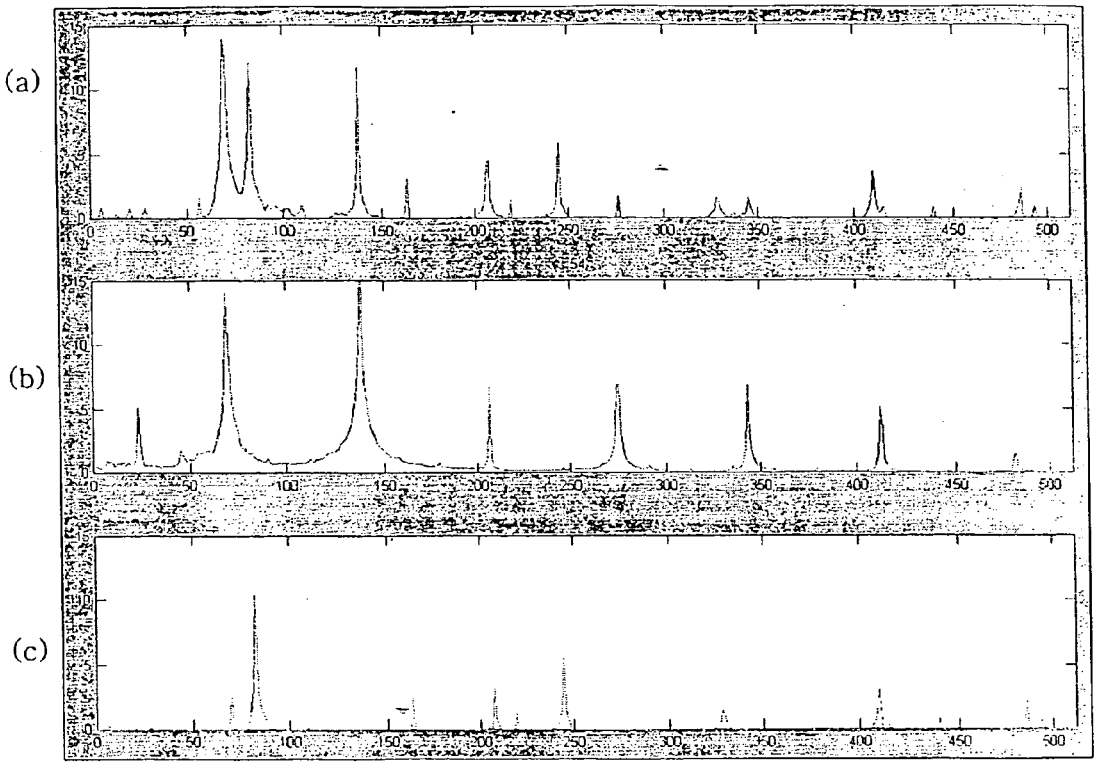
Figure 4C:
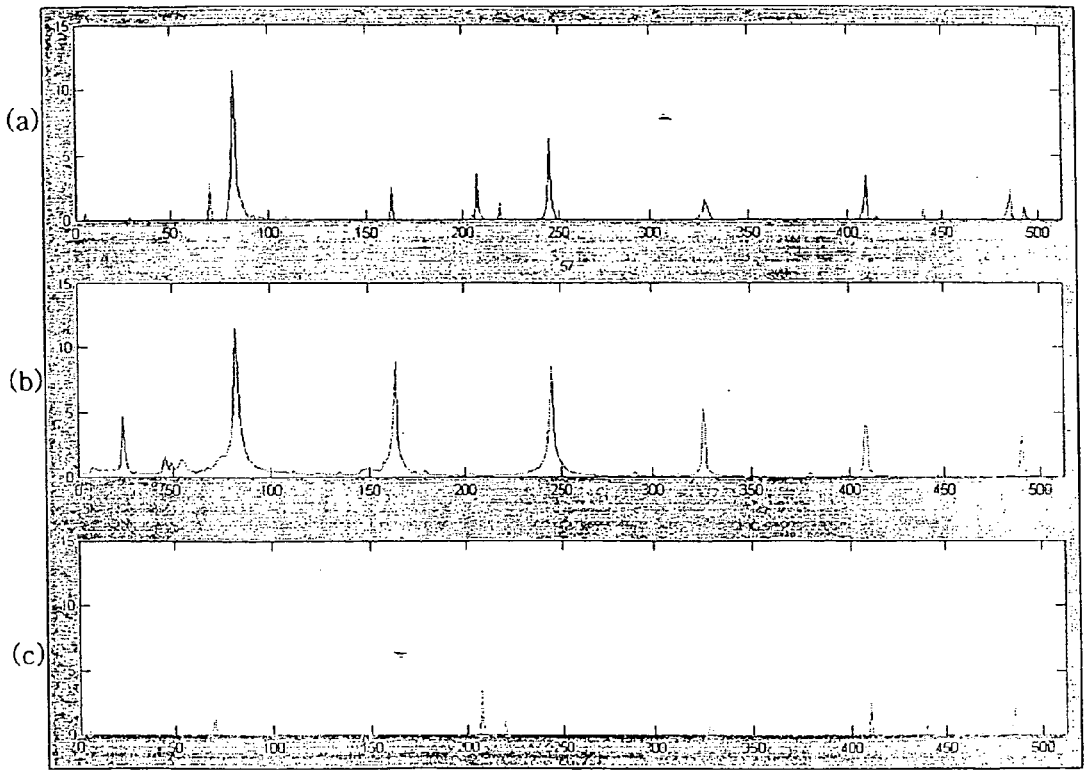

FIGS. 4A through 4C are diagrams showing the waveforms of frequencies in order to explain a procedure in which a monophonic note is detected from a plurality of performing notes using an apparatus for analyzing music according to the first embodiment of the present invention. The X axis indicates a pitch, i.e., a fast Fourier transform (FFT) index, and the Y axis indicates the strength of each frequency component, i.e., a magnitude as the result of FFT.

Step s520 will be described in more detail with reference to FIGS. 4A through 4C.

In FIG. 4A, a waveform (a) shows a case where the current frame of the input digital sound signal includes three notes D3, F3#, and A3. In this case, the fundamental frequency component of the note D3 is selected as the lowest peak frequency component among the peak frequency components included in the current frame in step s521. In the sound information of the particular instrument, sound information including the fundamental frequency component of the note D3 is detected in step s522. In step s522, sound information of many notes, such as D3, D2, and A1, can be detected.

Then, in the sound information detected in step s522, the sound information of the note D3 having a most similar peak frequency component to the peak frequency component selected in step s521 is detected as monophonic information of the selected peak frequency component in step s523. The monophonic information of the note D3 is shown in a waveform (b) in FIG. 4A.

Thereafter, the monophonic information of the note D3 (FIG. 4A(b)), is removed from the frequency components of the notes D3, F3#, and A3 included in the current frame of the digital sound signal in step s524.

Then, the frequency components of the notes F3# and A3, as shown in FIG. 4A(c), remain in the current frame. Steps s521 through s524 are repeated until there remains no frequency component in the current frame so that monophonic information of all notes included in the current frame can be detected.

In the above case, monophonic information of all notes D3, F3#, and A3 can be detected by repeating steps s521 through s524 three times.

FIG. 4B is a diagram for explaining a procedure of detecting and removing the note F3# in the above case. FIG. 4B(a) shows the frequency components of the notes F3# and A3 remaining in the sound information of the current frame after removing the note D3 from the notes D3, F3#, and A3. FIG. 4B(b) shows the frequency components of the note F3# detected through the above steps. FIG. 4B(c) shows the frequency components of the note A3 remaining after removing the note F3# (FIG. 4B(b)) from the waveform shown in FIG. 4B(a).

FIG. 4C is a diagram for explaining a procedure of detecting and removing the note A3 in the above case. FIG. 4C(a) shows the frequency components of the notes A3 remaining in the sound information of the current frame after removing the note F3# from the notes F3# and A3. FIG. 4C(b) shows the frequency components of the note A3 detected through the above steps. FIG. 4C(c) shows remaining frequency components after removing the note A3 (FIG. 4C(b)) from the waveform shown in FIG. 4C(a). Since all of the three performing notes have been detected, the remaining frequency components have strength near zero. Accordingly, the remaining frequency components are considered as being caused by nose.

Figure 5:
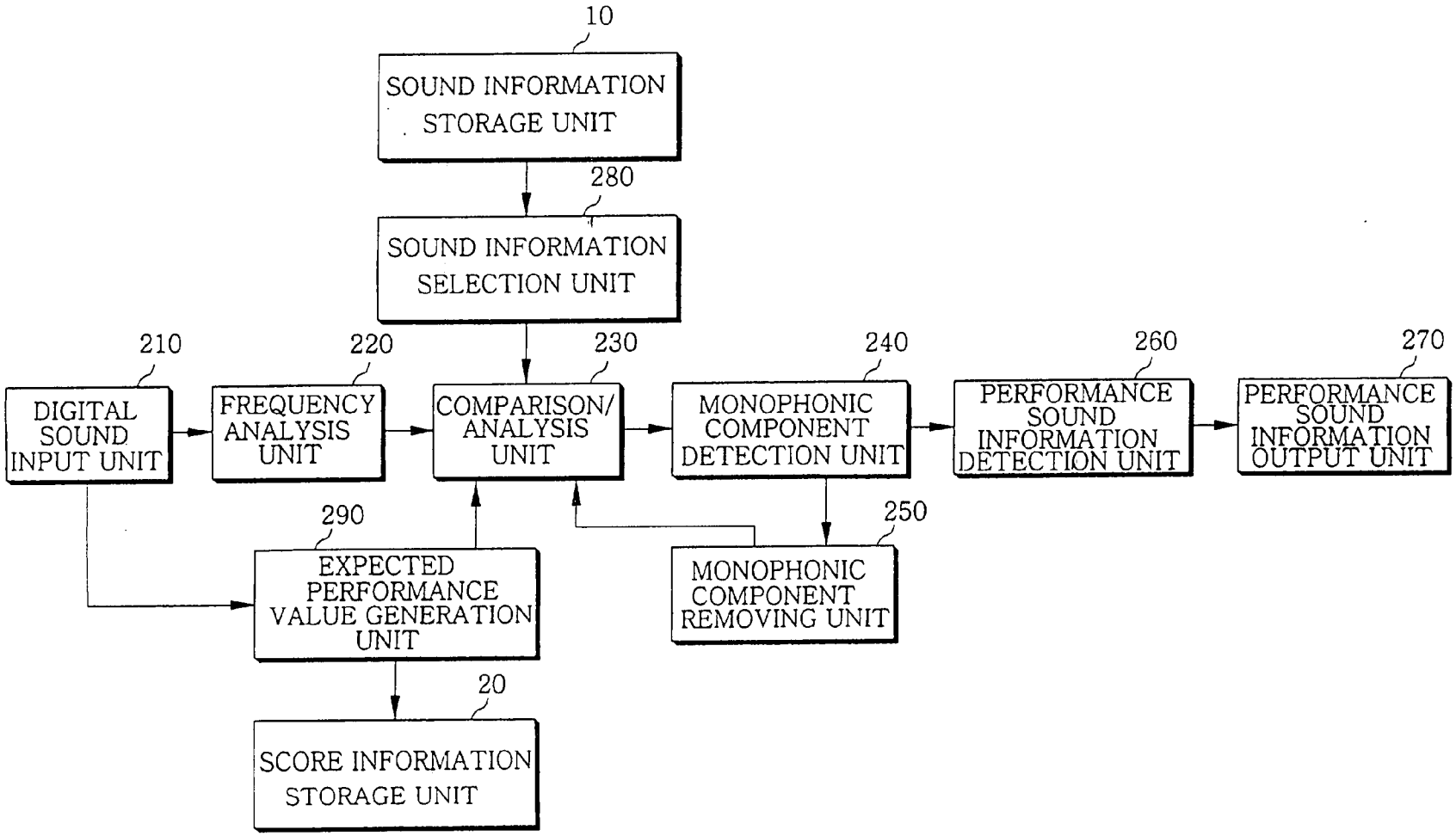
FIG. 5 is a schematic block diagram of an apparatus for analyzing music according to a second embodiment of the present invention.

FIG. 5 is a schematic block diagram of an apparatus for analyzing music according to a second embodiment of the present invention.

In the second embodiment of the present invention, sound information of an instrument and information of a score to be performed are used. If all information of each note having different frequency components can be constructed into the sound information of each instrument, an input digital sound signal can be accurately analyzed. However, actually, since it is difficult to construct all information of each note into the sound information of each instrument, the second embodiment of the present invention is provided to overcome this problem. In other words, in the second embodiment of the present invention, score information of a musical performance is detected, notes to be input are predicted based on the sound information of a particular instrument and the score information, and input digital sound is analyzed using information on the predicted notes.

Referring to FIG. 5, the apparatus for analyzing music according to the second embodiment of the present invention includes a sound information storage unit 10, a score information storage unit 20, a digital sound input unit 210, a frequency analysis unit 220, a comparison/analysis unit 230, a monophonic component detection unit 240, a monophonic component removing unit 250, an expected performance value generation unit 290, a performance sound information detection unit 260, a performance sound information output unit 270, and a sound information selection unit 280.

The sound information storage unit 10 separately stores sound information by types of instruments. The sound information selection unit 280 selects sound information "A" of a desired instrument from the sound information of different types of instruments stored in the sound information storage unit 10 and outputs the selected sound information "A". Here, the sound information storage unit 10 stores the sound information in the form of wave data or as the strengths of different frequency components. In a case where the sound information is stored in the form of wave data, if the sound information selection unit 280 generates a sound information request, the sound information storage unit 10 detects frequency components of a requested sound from the wave data and provides them.

The score information storage unit 20 stores information on a score to be performed by a particular instrument. The score information storage unit 20 stores and manages at least one type of information among pitch information, note length information, tempo information, rhythmic information, note strength information, detailed performance information (e.g., staccato, staccatissimo, and pralltriller), and discrimination information for performance using both hands or performance using a plurality of instruments, based on the score to be performed.

The digital sound input unit 210 receives externally performed music and converts it into a digital sound signal. The frequency analysis unit 220 receives the digital sound signal from the digital sound input unit 210, decomposes it into frequency components "F" in units of frames, and outputs the frequency components "F" in units of frames.

The expected performance value generation unit 290 commences an operation when music sound is input through the digital sound input unit 210, generates expected performance values "E" in units of frames based on the score information stored in the score information storage unit 20 as time lapses since it commenced the operation, and outputs the expected performance value "E" in units of frames.

The comparison/analysis unit 230 receives the sound information "A" output from the sound information selection unit 280, the frequency components "F" output from the frequency analysis unit 220 in units of frames, and the expected performance values "E" output from the expected performance value generation unit 290; selects a lowest expected performance value "$E_{L1}$" from the expected performance values "E" that have not been compared with the frequency components "F"; detects sound information "$A_{L1}$" corresponding to the lowest expected performance value "$E_{L1}$"; and determines whether the sound information "$A_{L1}$" is included in the frequency components "F".

The monophonic component detection unit 240 receives the sound information "$A_{L1}$" corresponding to the lowest expected performance value "$E_{L1}$" and the frequency components "F". When the comparison/analysis unit 230 determines that the sound information "$A_{L1}$" is included in the frequency components "F", the monophonic component detection unit 240 detects the sound information "$A_{L1}$" as a monophonic component "$A_S$".

In the meantime, the monophonic component detection unit 240 detects time information of each frame and the pitch and strength of each monophonic note included in each frame. In addition, when the detected monophonic component "$A_S$" is a new one that has not been included in the previous frame, the monophonic component detection unit 240 divides the current frame including the new monophonic component "$A_S$" into a plurality of subframes, founds out a subframe including the new monophonic component "$A_S$", and detects time information of the found subframe together with the monophonic component "$A_S$", i.e., pitch and strength information.

When the comparison/analysis unit 230 determines that the sound information "$A_{L1}$" is not included in the frequency components "F", the monophonic component detection unit 240 detects historical information indicating how many consecutive frames the sound information "$A_{L1}$" is included in and when the sound information "$A_{L1}$" is not included in a predetermined number of consecutive frames, removes the sound information "$A_{L1}$" from the expected performance values "E".

The monophonic component removing unit 250 receives the monophonic component "$A_S$" and the frequency components "F" from the monophonic component detection unit 240, removes the monophonic component "$A_S$" from the frequency components "F", and transmits the result of the removal ($F \leftarrow F - A_S$) to the comparison/analysis unit 230.

In the meantime, when expected performance values with respect to a frame for which frequency components are generated by the frequency analysis unit 220 are not generated by the expected performance value generation unit 290, the comparison/analysis unit 230 receives the sound information "A" output from the sound information selection unit 280 and the frequency components "F" output from the frequency analysis unit 220 in units of frames. Then, the comparison/analysis unit 230 selects a lowest peak frequency "$F_{PL}$" from the peak frequencies of the frequency components "F" in a current frame and detects sound information "$A_{PL}$" including the lowest peak frequency "$F_{PL}$" in the sound information "A" output from the sound information selection unit 280.

The monophonic component detection unit 240 receives the sound information "$A_{PL}$", the frequency components "F", and the lowest peak frequency "$F_{PL}$" from the comparison/analysis unit 230, and detects, as performance error information "Er", sound information "$A_F$" that has peak information most similar to the lowest peak frequency "$F_{PL}$" in the sound information "$A_{PL}$". In addition, the monophonic component detection unit 240 searches the score information and determines whether the performance error information "Er" is included in notes to be performed next in the score information. If it is determined that the performance error information "Er" is included in the notes to be performed next in the score information, the monophonic component detection unit 240 adds the performance error information "Er" to the expected performance values "E" and outputs sound information corresponding to the performance error information "Er" as a monophonic component "$A_S$". If it is determined that the performance error information "Er" is not included in the notes to be performed next in the score information, the monophonic component detection unit 240 outputs the sound information corresponding to the performance error information "Er" as an error note component "$E_S$".

When the error note component "$E_S$" is detected by the monophonic component detection unit 240, the monophonic component removing unit 250 receives the error note component "$E_S$" and the frequency components "F" from the monophonic component detection unit 240, removes the error note component "$E_S$" from the frequency components "F", and transmits the result of the removal ($F \leftarrow F - E_S$) to the comparison/analysis unit 230.

Then, the comparison/analysis unit 230 determines whether the frequency components "F" received from the monophonic component removing unit 250 include effective peak frequency information. When it is determined that effective peak frequency information is included in the frequency components "F" received from the monophonic component removing unit 250, the comparison/analysis unit 230 performs the above described operation on the frequency components "F" received from the monophonic component removing unit 250. However, when it is determined that effective peak frequency information is not included in the frequency components "F" received from the monophonic component removing unit 250, the comparison/analysis unit 230 receives frequency components of a next frame of the input digital sound signal from the frequency analysis unit 220 and performs the above described operation on the frequency components of the next frame.

The performance sound information detection unit 260 and the performance sound information output unit 270 perform the same functions as the performance sound information detection unit 160 and the performance sound information output unit 170 in the first embodiment of the present invention, and thus detailed descriptions thereof will be omitted.

Figure 6:
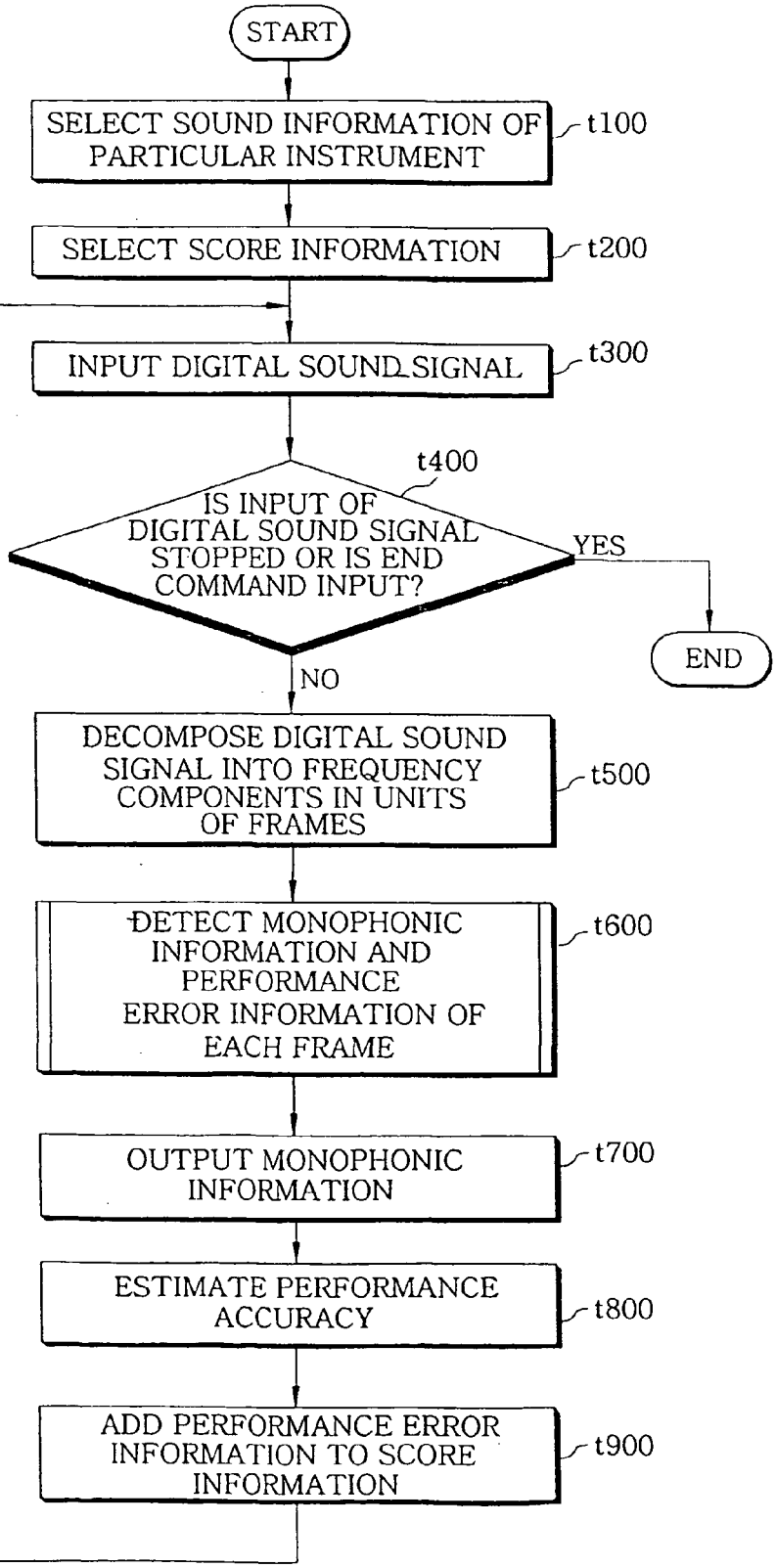
FIG. 6 is a flowchart of a procedure of analyzing music using an apparatus for analyzing music according to the second embodiment of the present invention.

FIG. 6 is a flowchart of a procedure of analyzing music using an apparatus for analyzing music according to the second embodiment of the present invention.

The following description concerns a procedure of analyzing externally input digital sound based on sound information of different types of instruments and score information using an apparatus for analyzing music according to the second embodiment of the present invention.

After sound information of different types of instruments and score information of music to be performed are generated and stored (not shown), sound information of a particular instrument to be actually played and score information of music to be actually performed are selected from the stored sound information of different types of instruments and score information in steps t100 and t200. A method of generating the score information of music to be performed is beyond the scope of the present invention. At present, there are many techniques of scanning a score printed on paper, converting the scanned score into performance information of music instrument digital interface (MIDI) music, and storing the performance information. Thus, a detailed description of generating and storing the score information will be omitted.

The score information includes, for example, pitch information, note length information, tempo information, rhythmic information, note strength information, detailed performance information (e.g., staccato, staccatissimo, and pralltriller), and discrimination information for performance using both hands or performance using a plurality of instruments.

After the sound information and the score information are selected in steps t100 and t200, if a digital sound signal is input in step t300, the digital sound signal is decomposed into frequency components in units of frames in step t500. The frequency components of the digital sound signal are compared with the selected score information and the frequency components of the selected sound information and analyzed so as to detect performance error information and monophonic information of a current frame from the digital sound signal in step t600.

Thereafter, the detected monophonic information is output in step t700.

Performance accuracy can be estimated based on the performance error information in step t800. If the performance error information corresponds to a note (for example, a variation) intentionally performed by a player, the performance error information is added to the score information in step t900. The steps t800 and t900 can be selectively performed.

Figure 6A:
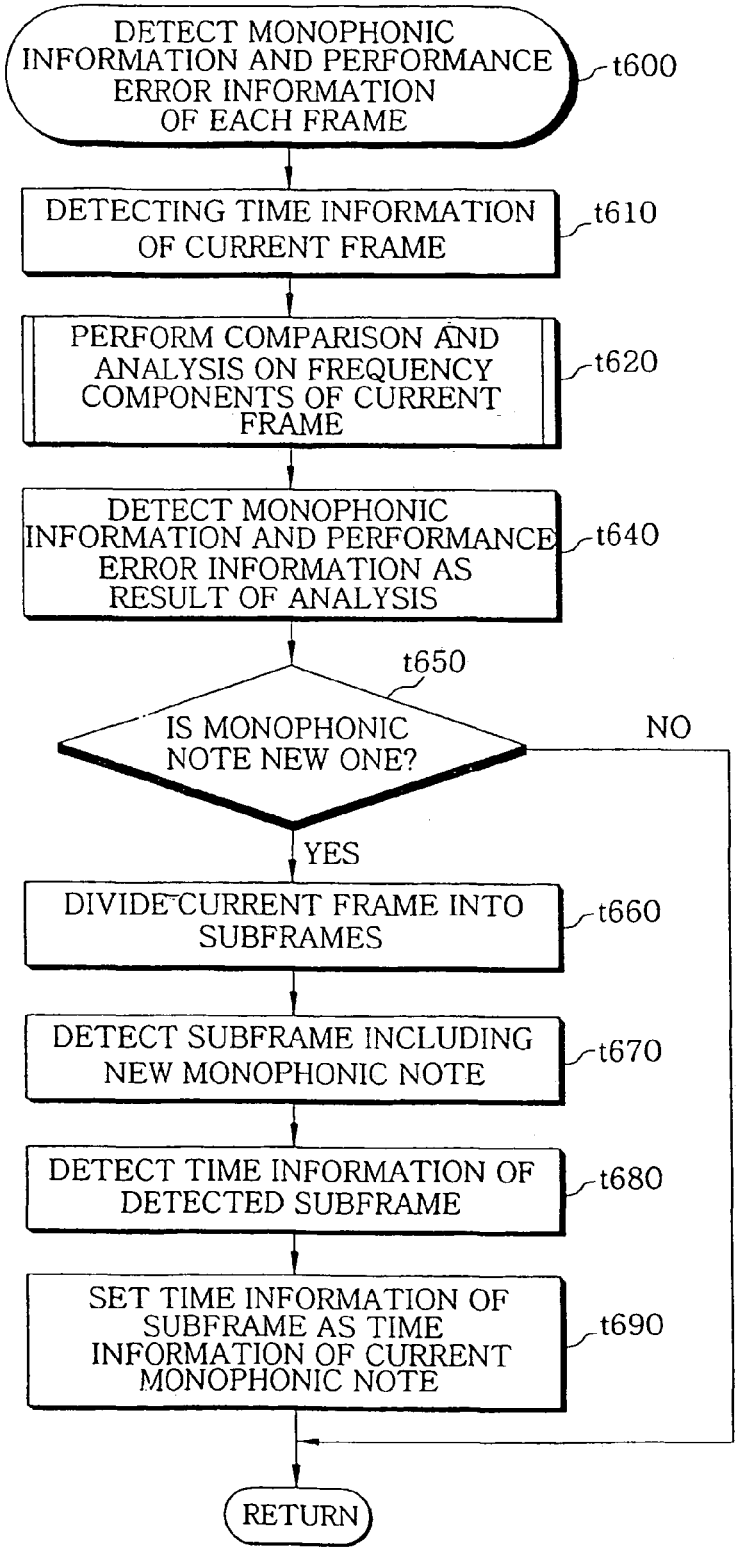
FIG. 6A is a flowchart of a procedure of detecting monophonic information and performance error information of a current frame using an apparatus for analyzing music according to the second embodiment of the present invention.

FIG. 6A is a flowchart of step t600 of detecting the monophonic information and the performance error information of the current frame using an apparatus for analyzing music according to the second embodiment of the present invention. Referring to FIG. 6A, time information of the current frame is detected in step t610. The frequency components of the current frame are compared with the frequency components of the selected sound information of the particular instrument and with the score information and are analyzed to detect pitch, strength and time information of each monophonic note included in the current frame in step t620. In step t640, as a result of the analysis, monophonic information and performance error information are detected with respect to the current frame.

If it is determined that a monophonic note corresponding to the detected monophonic information is a new one that is not included in the previous frame in step t650, the current frame is divided into a plurality of subframes in step t660. Among the plurality of subframes, a subframe which includes the new monophonic note is detected in step t670. Time information of the detected subframe is detected in step t680. The time information of the subframe is set as the time information of the monophonic information in step t690. Similar to the first embodiment, the steps t650 through t690 can be omitted either when the monophonic note is in a low frequency range or when the accuracy of time information is not required.

Figure 6B:
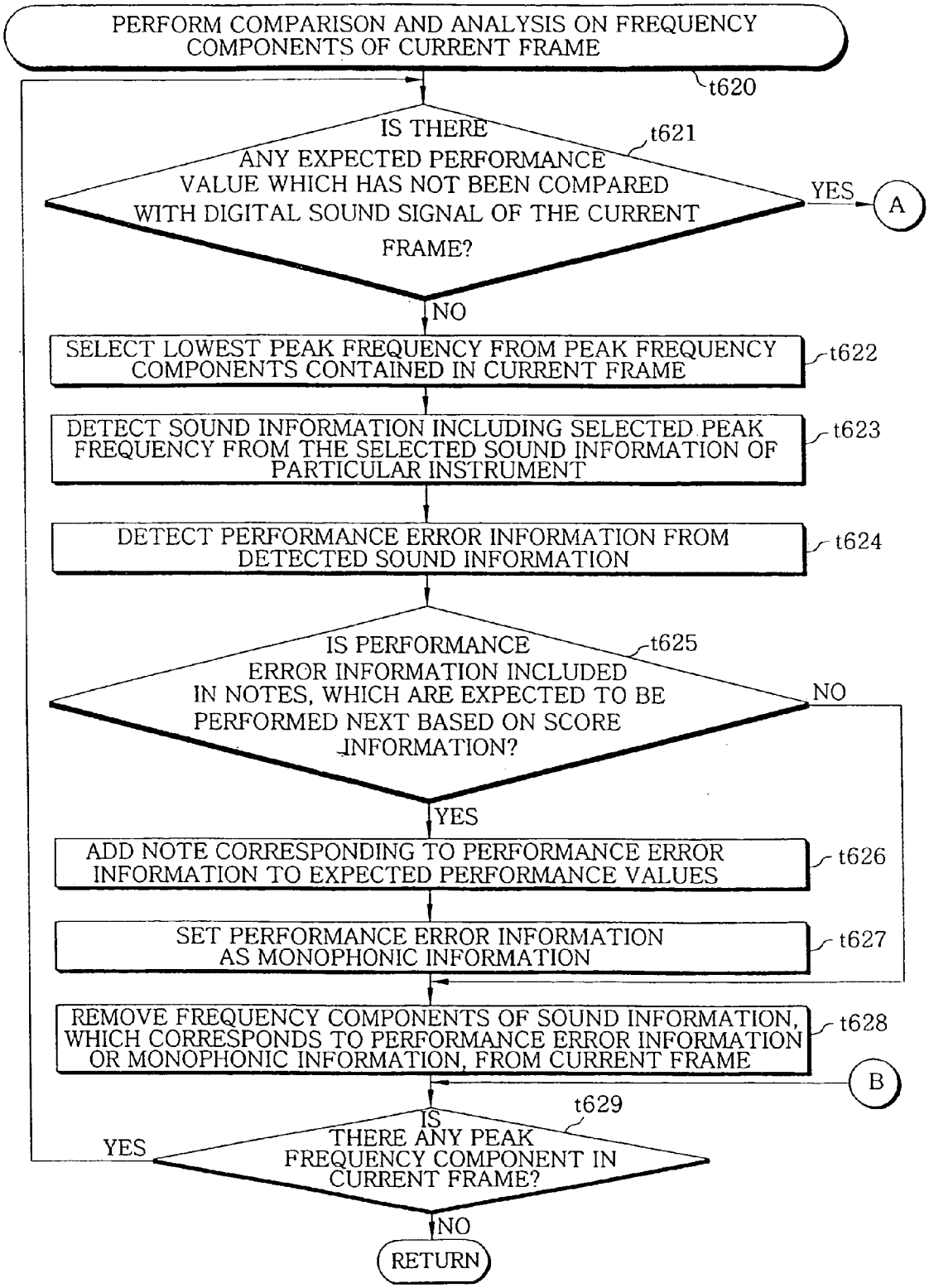
FIGS. 6B and 6C are flowcharts of a procedure of performing comparison and analysis on frequency components of the frame using an apparatus for analyzing music according to the second embodiment of the present invention.
Figure 6C:
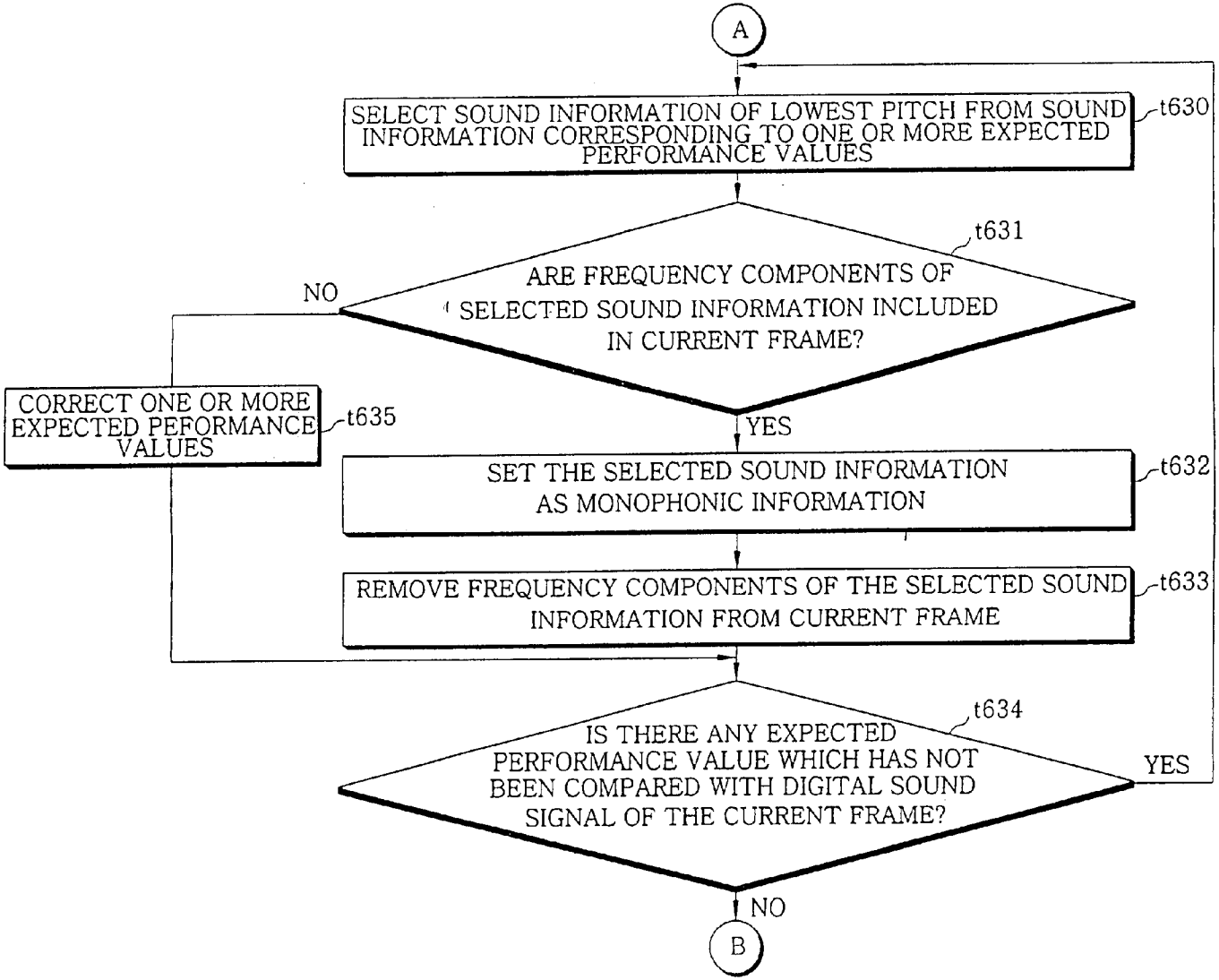

FIGS. 6B and 6C are flowcharts of step t620 of performing comparison and analysis on the frequency components of the current frame using an apparatus for analyzing music according to the second embodiment of the present invention. Referring to FIGS. 6B and 6C, in step t621, with respect to the digital sound signal, which is generated in real time as the particular instrument is performed, expected performance values of the current frame are generated, and it is determined whether there is any expected performance value which has not been compared with real performance sound, i.e., the digital sound signal, in the current frame.

If it is determined that there is no expected performance value which has not been compared with the digital sound signal in the current frame in step t621, it is determined whether the frequency components of the digital sound signal in the current frame correspond to performance error information; performance error information and monophonic information are detected; and the frequency components of sound information, which corresponds to the performance error information and the monophonic information, are removed from the digital sound signal in the current frame, in steps t622 through t628.

More specifically, a lowest peak frequency of the input digital sound signal in the current frame is selected in step t622. Sound information containing the selected peak frequency is detected from the sound information of the particular instrument in step t623. Sound information containing most similar peak information to the component of the selected peak frequency is detected from the sound information detected in step t623, as performance error information in step t624. If it is determined that the performance error information is included in notes, which are expected to be performed next based on the score information, in step t625, notes corresponding to the performance error information are added to the expected performance values in step t626. Next, the performance error information is set as monophonic information in step t627. The frequency components of the sound information detected as the performance error information or the monophonic information in step t624 or t627 are removed from the current frame of the digital sound signal in step t628.

If it is determined that there is any expected performance value which has not been compared with the digital sound signal in the current frame in step t621, the digital sound signal is compared with the one or more expected performance values and analyzed to detect monophonic information of the current frame, and the frequency components of sound information corresponding to the monophonic information are removed from the current frame of the digital sound signal, in steps t630 through t634.

More specifically, sound information of a lowest pitch which has not been compared with frequency components included in the current frame of the digital sound signal is selected from sound information corresponding to the one or more expected performance values, which have not been compared, in step t630. If it is determined that the frequency components of the sound information selected in step t630 are included in the frequency components included in the current frame of the digital sound signal in step t631, the selected sound information is set as monophonic information in step t632. Then, the frequency components of the selected sound information are removed from the current frame of the digital sound signal in step t633. If it is determined that the frequency components of the selected sound information are not included in the frequency components included in the current frame of the digital sound signal in step t631, the one or more expected performance values are corrected in step t635. The steps t630 through t633 are repeated until it is determined that every note corresponding to the one or more expected performance values has compared with the digital sound signal of the current frame in step t634.

The steps t621 through t628 and t630 through t635 shown in FIGS. 6B and 6C are repeated until it is determined that no peak frequency component is left in the digital sound signal in the current frame in step t629.

Figure 6D:
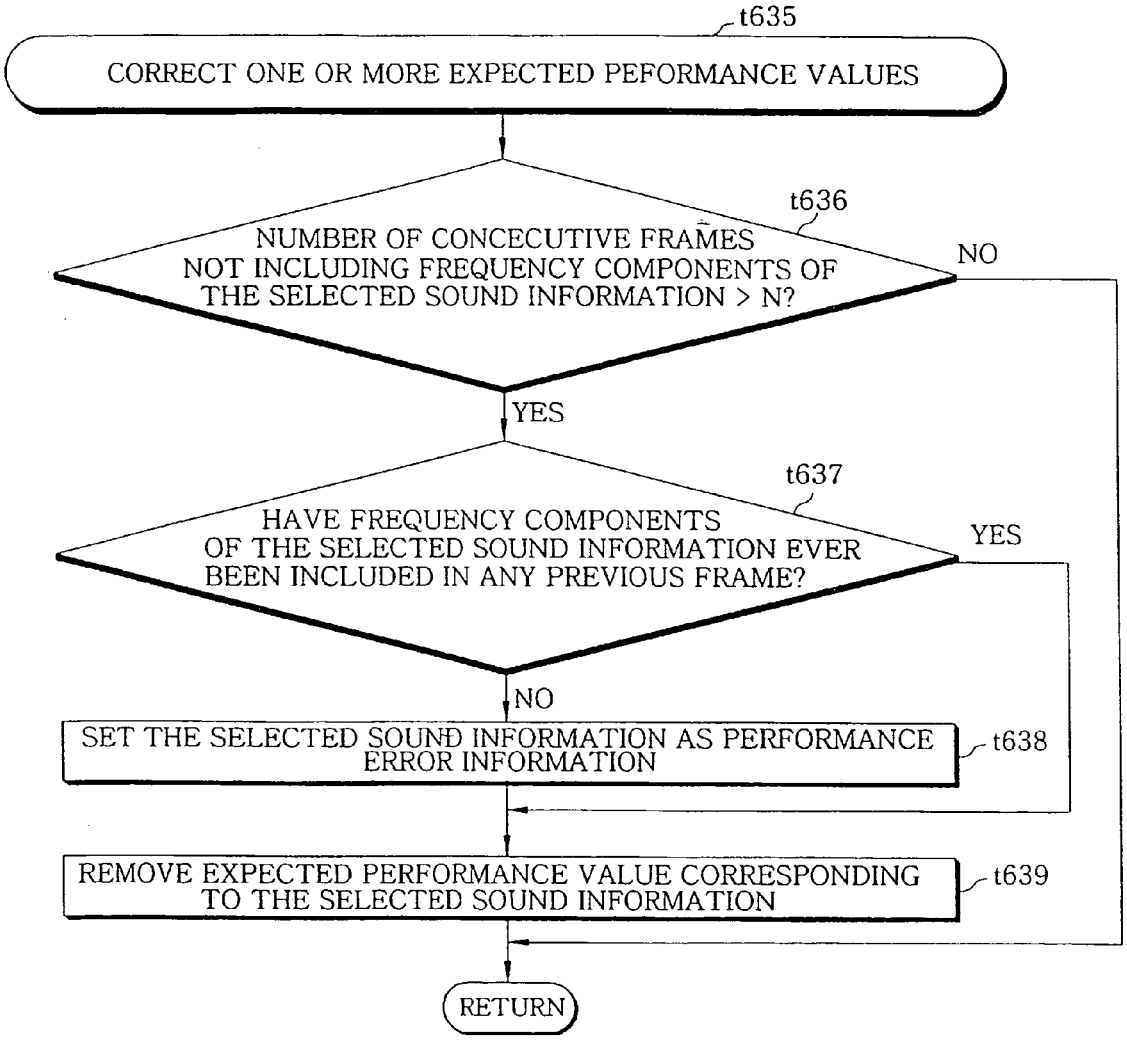
FIG. 6D is a flowchart of a procedure of correcting an expected performance value using an apparatus for analyzing music according to the second embodiment of the present invention.

FIG. 6D is a flowchart of step 635 of correcting the one or more expected performance values using an apparatus for analyzing music according to the second embodiment of the present invention. Referring to FIG. 6D, if it is determined that the frequency components of the sound information selected in step t630 are not included in at least a predetermined number N of consecutive previous frames N in step t636, and if it is determined that the frequency components of the selected sound information have been included in at least one previous frame of the digital sound signal in step t637, an expected performance value corresponding to the selected sound information is removed in step t639. Alternatively, if it is determined that the frequency components of the selected sound information are not included in at least the predetermined number N of consecutive previous frames N in step t636, and if it is determined that the frequency components of the selected sound information have never been included in any previous frame of the digital sound signal in step t637, the selected sound information is set as the performance error information in step t638, and an expected performance value corresponding to the selected sound information is removed in step t639.

The above description just concerns embodiments of the present invention. The present invention is not restricted to the above embodiments, and various modifications can be made thereto within the scope defined by the attached claims. For example, the shape and structure of each member specified in the embodiments can be changed.

INDUSTRIAL APPLICABILITY

An apparatus for analyzing music according to the present invention uses sound information or sound information and score information, thereby quickly analyzing input digital sounds and increasing the accuracy of analysis. In conventional approaches of analyzing digital sounds, music composed of polyphonic pitches, for example, piano music, cannot be analyzed. However, according to the present invention, as well as monophonic pitches, polyphonic pitches contained in digital sounds can be quickly and accurately analyzed.

Therefore, the result of analyzing digital sounds according to the present invention can be directly applied to an electronic score, and performance information can be quantitatively detected using the result of the analysis. This result of the analysis can be widely used in from musical education for children to professional players' practice. That is, by using a technique of the present invention allowing input digital sounds to be analyzed in real time, positions of currently performed notes on the electronic score are recognized in real time and positions of notes to be performed next are automatically indicated on the electronic score, so that players can concentrate on performance without caring about turning over the leaves of a paper score.

In addition, the present invention compares performance information obtained as the result of the analysis with previously stored score information to detect performance accuracy so that players can be informed about wrong performance. The detected performance accuracy can be used as data by which a player's performance is evaluated.

What is claimed is:

1. An apparatus for analyzing music, comprising:

a sound information storage unit, which separately stores sound information by types of instruments;

a sound information selection unit, which selects sound information of a particular instrument from the sound information of different types of instruments stored in the sound information storage unit and outputs the selected sound information;

a digital sound input unit, which receives externally performed music and converts it into a digital sound signal;

a frequency analysis unit, which receives the digital sound signal from the digital sound input unit, decomposes it into frequency components, and outputs the frequency components in units of frames;

a comparison/analysis unit, which receives the sound information output from the sound information selection unit and the frequency components output from the frequency analysis unit in units of frames, selects a lowest peak frequency from peak frequencies of the frequency components in each frame output from the frequency analysis unit, and detects sound information including the lowest peak frequency from the sound information output from the sound information selection unit;

a monophonic component detection unit, which receives the detected sound information, the frequency components of the digital sound signal, and the lowest peak frequency from the comparison/analysis unit and detects, as a monophonic component, sound information that has peak information most similar to the lowest peak frequency in the sound information;

a monophonic component removing unit, which receives the lowest peak frequency that has been used to detect the monophonic component and the frequency components of the digital sound signal from the monophonic component detection unit, removes the lowest peak frequency from the frequency components, and transmits the result of the removal to the comparison/analysis unit;

a performance sound information detection unit, which combines monophonic components, which have been detected by the monophonic component detection unit, to detect performance sound information; and a performance sound information output unit, which outputs the performance sound information.

2. The apparatus of claim 1, wherein the sound information storage unit stores the sound information of different types of instruments in the form of wave data, and when a sound information request is generated from an external device, the sound information storage unit detects frequency components of sound information corresponding to the sound information request from the wave data and provides them.

3. The apparatus of claim 1, wherein the sound information storage unit stores the sound information of different types of instruments in the form of strength of different frequency components, which can be directly expressed.

4. The apparatus of claim 1, wherein the monophonic component detection unit detects time information of each frame and then detects pitch and strength of each monophonic note included in each frame.

5. The apparatus of claim 4, wherein when the detected monophonic component is a new one that has not been included in a previous frame, the monophonic component detection unit divides the current frame including the new monophonic component into a plurality of subframes, founds out a subframe including the new monophonic component, and detects time information of the found subframe together pitch and strength information of a monophonic note corresponding to each monophonic component.

6. The apparatus of claim 1, wherein when it is determined that the frequency components received from the monophonic component removing unit include effective peak frequency information, the comparison/analysis unit selects a lowest peak frequency from the effective peak frequency information and detects sound information including the selected lowest peak frequency, and when it is determined that the frequency components received from the monophonic component removing unit does not include effective peak frequency information, the comparison/analysis unit receives frequency components of a next frame from the frequency analysis unit, selects a lowest peak frequency from peak frequencies included in the received frequency components, and detects sound information including the selected lowest peak frequency.

7. An apparatus for analyzing music, comprising:

a sound information storage unit, which separately stores sound information by types of instruments;

a sound information selection unit, which selects sound information of a particular instrument from the sound information of different types of instruments stored in the sound information storage unit and outputs the selected sound information;

a score information storage unit, which stores information on a score to be performed by a particular instrument, i.e., score information;

a digital sound input unit, which receives externally performed music and converts it into a digital sound signal;

a frequency analysis unit, which receives the digital sound signal from the digital sound input unit, decomposes it into frequency components, and outputs the frequency components in units of frames;

an expected performance value generation unit, which commences an operation in response to an external control signal, generates expected performance values in units of frames based on the score information stored in the score information storage unit as time lapses since it commenced the operation, and outputs the expected performance value in units of frames;

a comparison/analysis unit, which receives the sound information output from the sound information selection unit, the frequency components output in units of frames from the frequency analysis unit, and the expected performance values output from the expected performance value generation unit, selects a lowest expected performance value from expected performance values that have not been compared with the frequency components, detects sound information corresponding to the lowest expected performance value, and determines whether the detected sound information corresponding to the lowest expected performance value is included in the frequency components;

a monophonic component detection unit, which receives the sound information corresponding to the lowest expected performance value and the frequency components and when the comparison/analysis unit determines that the sound information corresponding to the lowest expected performance value is included in the frequency components, detects the received sound information as a monophonic component;

a monophonic component removing unit, which receives the monophonic component and the frequency components of the digital sound signal from the monophonic component detection unit, removes the monophonic component from the frequency components, and transmits the result of the removal to the comparison/analysis unit;

a performance sound information detection unit, which combines monophonic components, which have been detected by the monophonic component detection unit, to detect performance sound information; and a performance sound information output unit, which outputs the performance sound information.

8. The apparatus of claim 7, wherein the monophonic component detection unit detects time information of each frame and then detects pitch and strength of each monophonic note included in each frame.

9. The apparatus of claim 8, wherein when the detected monophonic component is a new one that has not been included in a previous frame, the monophonic component detection unit divides the current frame including the new monophonic component into a plurality of subframes, founds out a subframe including the new monophonic component, and detects time information of the found subframe together pitch and strength information of a monophonic note corresponding to each monophonic component.

10. The apparatus of any one of claims 7 through 9, wherein when the comparison/analysis unit determines that the sound information corresponding to the lowest expected performance value is not included in the frequency components, the monophonic component detection unit detects historical information indicating in how many consecutive frames the sound information corresponding to the lowest expected performance value is included, and when the sound information corresponding to the lowest expected performance value is not included in a predetermined number of consecutive frames, removes the sound information corresponding to the lowest expected performance value from the expected performance values.

11. The apparatus of claim 10, wherein when expected performance values with respect to a frame for which frequency components are generated by the frequency analysis unit are not generated, the comparison/analysis unit receives the sound information of the particular instrument output from the sound information selection unit and the frequency components output from the frequency analysis unit in units of frames, selects a lowest peak frequency from the peak frequencies of the frequency components in a current frame, and detects sound information including the lowest peak frequency from the sound information output from the sound information selection unit.

12. The apparatus of claim 11, wherein the monophonic component detection unit receives the detected sound information, the frequency components, and the lowest peak frequency from the comparison/analysis unit, detects, as performance error information, sound information that has peak information most similar to the lowest peak frequency from the sound information detected by the comparison/analysis unit, and adds the performance error information to the expected performance values and outputs sound information corresponding to the performance error information as the monophonic component when it is determined that the performance error information is included in notes to be performed next in the score information.

13. The apparatus of claim 12, wherein when it is determined that the performance error information is not included in the notes to be performed next in the score information, the monophonic component detection unit outputs the sound information corresponding to the performance error information as an error note component.

14. The apparatus of claim 13, wherein the monophonic component removing unit receives the error note component and the frequency components from the monophonic component detection unit, removes the error note component from the frequency components, and transmits the result of the removal to the comparison/analysis unit.

15. The apparatus of claim 13, wherein, the comparison/analysis unit receives the frequency components from the monophonic component removing unit as an input when it is determined that effective peak frequency information is included in the frequency components received from the monophonic component removing unit and receives frequency components of a next frame of the input digital sound signal from the frequency analysis unit when it is determined that effective peak frequency information is not included in the frequency components received from the monophonic component removing unit.

16. The apparatus of claim 7, wherein the sound information storage unit stores the sound information of different types of instruments in the form of wave data, and when a sound information request is generated from an external device, the sound information storage unit detects frequency components of sound information corresponding to the sound information request from the wave data and provides them.

17. The apparatus of claim 7, wherein the sound information storage unit stores the sound information of different types of instruments in the form of strength of different frequency components, which can be directly expressed.

* * * * *